United States Patent [19]

Maillard

[11] 3,965,603

[45] June 29, 1976

[54] DOUBLE ACTION REVOLVER

[75] Inventor: Gilbert Albert René Maillard, Montbeliard, France

[73] Assignee: Manufacture de Machines du Haut-Rhin S.A., Mulhouse Cedex, France

[22] Filed: May 9, 1974

[21] Appl. No.: 468,541

[30] Foreign Application Priority Data

May 9, 1973 France ..... 73.16700

[52] U.S. Cl. ..... 42/65; 42/66

[51] Int. Cl.[2] ..... F41C 19/00

[58] Field of Search ..... 42/65, 66

[56] References Cited

UNITED STATES PATENTS

| | | | |
|---|---|---|---|
| 763,581 | 6/1904 | Wesson | 42/65 |
| 811,807 | 2/1906 | Wesson | 42/65 |
| 961,188 | 6/1910 | Wesson | 42/66 |
| 3,242,607 | 3/1966 | Tappehorn | 42/65 |
| 3,245,167 | 4/1966 | Freed | 42/65 |

*Primary Examiner*—Charles T. Jordan

[57] ABSTRACT

Double action revolver having a slider with an opposing or withdrawing spring. The withdrawing spring of the rebounding slider is constituted by elastic arm of which one of the ends is fixed, and is maintained within the frame of the revolver, the other end of such spring being mobile and engaging a curved abutment surface connected to the slider, the point of engagement with said abutment surface varying as a function of the position of the slider in the frame. The slider is provided with rollers for rotation around two parallel axles and roll along a supporting plane surface provided in the frame.

5 Claims, 8 Drawing Figures

DOUBLE ACTION REVOLVER

The present invention relates to revolvers, more precisely, to revolvers of the type called "double-action" in which the trigger in the initial phase of its displacement by the marksman moves the hammer towards its cocked or armed position.

Double-action revolvers heretofor known generally carry within a frame:

a hammer pivotally mounted on a fixed axis for movement between the cocked and the advanced firing or percussion position;

a first spring urging the hammer towards its percussion position;

a trigger pivotally mounted upon the frame and adapted in the initial phase of its displacement by the marksman to urge, through the intermediary of an action mechanism, the trigger toward its cocked position in order that in the final phase of its displacement the hammer is released and moves towards its percussion position;

a rebounding slider mounted to move within the frame under the action of the trigger to which it is connected in order to urge the hammer toward and maintain it in an intermediate safety position, when, after the percussion stroke of the hammer, the trigger regains its rest position under the action of a second spring acting upon the trigger through the intermediary of the slider.

The second spring, mentioned above, has for its function not only to restore the trigger to its advanced "at rest" position, but also to permit the hammer, through the intermediary of the rebounding slider, to be returned into its intermediate or safety position. The second spring thus has a force sufficient to overcome the action upon the hammer of the first spring, mentioned above, which normally urges the hammer towards its percussion position.

In most of the known revolvers, such second spring is constituted by a coil compression spring of which the compression is not in general adjustable, or frequently as one of the elastic branches of a V spring of which the other branch, moreover, most often forms the (first) spring for the hammer.

At the time of pulling of the double-action, the force exerted by the marksman upon the trigger must on one hand overcome the action on the trigger by the hammer spring, and on the other hand, the force exerted upon the trigger by its spring. This last force increases as a function of the degree of displacement of the trigger; the range of travel of the trigger has to be sufficient to assure the displacement of the hammer towards its cocked position. The result of this is that the force required by the marksman to be exerted upon the trigger increases as the hammer approaches its fully cocked position in which it becomes free to perform its firing stroke: this makes it difficult for the marksman to achieve accuracy in shooting the revolver.

The present invention has among its objects the overcoming of such disadvantage. In accordance with the invention there is provided a double-action revolver in which the force exerted by the second spring upon the trigger remains substantially constant and independent of the distance of travel of the trigger, so that the revolver has a great regularity of "weight" or pull of its double-action, and thus greatly improves the sensitivity of the trigger action.

To this end, the revolver according to the invention, which is of the type defined above, is characterized in that its second (trigger) spring is constituted by a leaf spring of which one of its extremities is fixed and maintained in the frame and of which the other extremity is movable and engages a curved abutment surface connected to and movable with the slider, the point of engagement upon such abutment surface varying as a function of the position of the slider in the frame. The elastic characteristics of the trigger spring and the form of the abutment surface are such that the force component of the force exerted upon the slider by said leaf spring parallel to the direction of the displacement of the slider remains substantially constant regardless of the position of the slider relative to the frame.

With such disposition it can be easily understood that the action upon the trigger by the leaf spring which constitutes the second or trigger spring, as explained above, remains substantially constant, no matter what the position of the trigger may be in its range of movement.

In accordance with the illustrative preferred embodiment, the slider is provided with rollers for rotation on two parallel axes, the rollers travelling on a supporting plane surface provided in the frame and thus facilitating the displacement of the slider in the frame. The revolver is preferably provided with adjusting means for the leaf trigger spring to permit the position of the fixed end of such spring to be adjusted relative to the frame, and thus to regulate the force of recoil exerted by the hammer upon the assembly of the slider in the trigger. Such arrangement permits the reduction to a minimum of the "weight" upon the trigger imposed by the double-action.

According to a particularly interesting embodiment, the revolver of the invention also includes an internal supplemental safety operated by the trigger to prevent the hammer from reaching its percussion position so long as the marksman does not pull on the trigger.

The invention will be better understood upon consideration of the following description which refers to the drawings annexed thereto, disclosing a preferred embodiment of the revolver:

Figures 1, 8:
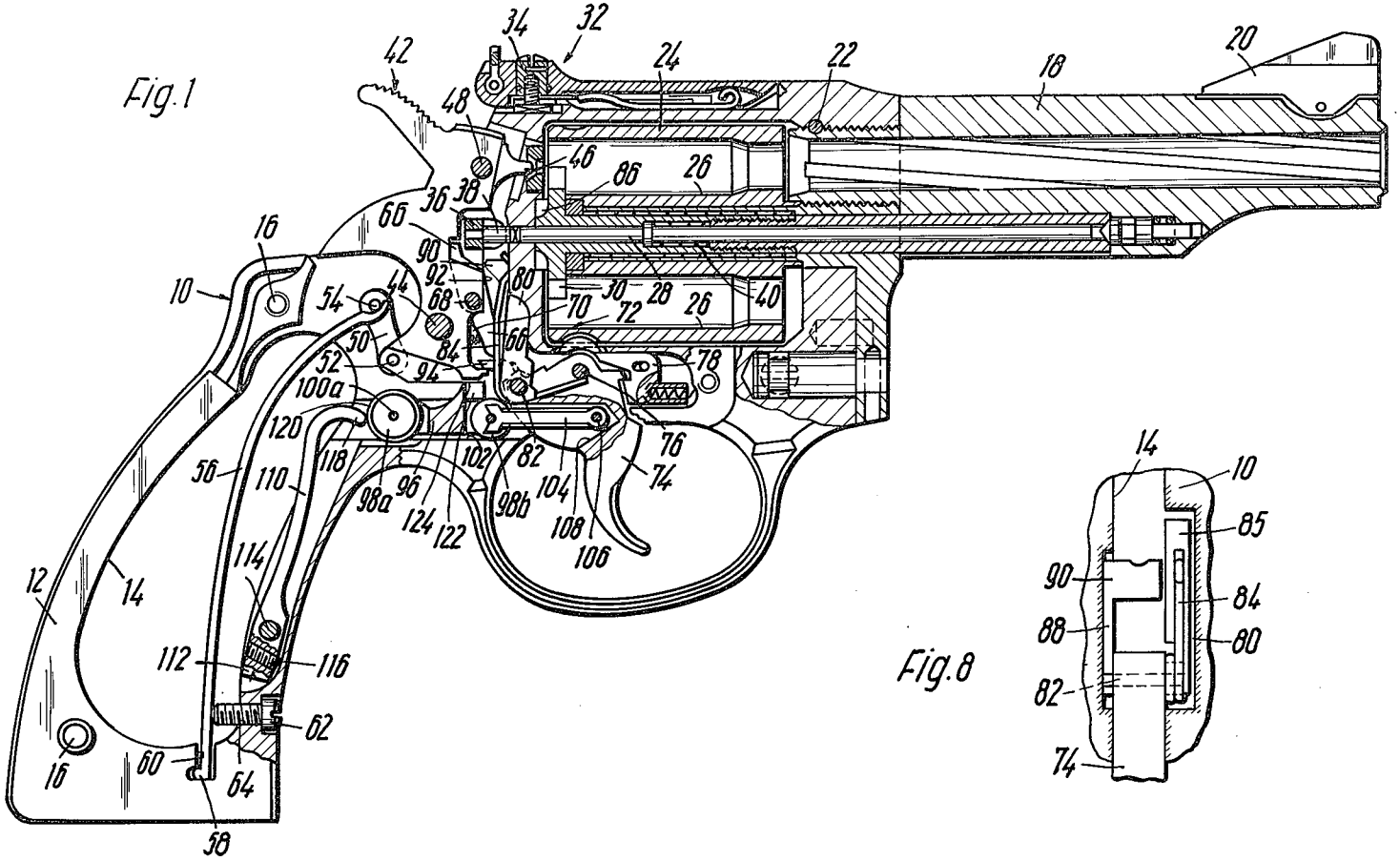
FIG. 1 is a view in longitudinal section through the revolver according to the invention.
FIG. 8 is a fragmentary view in elevation showing in detail the supplemental safety of the revolver of FIG. 1, certain of the elements being omitted for the clarity of illustration.
Figure 2:
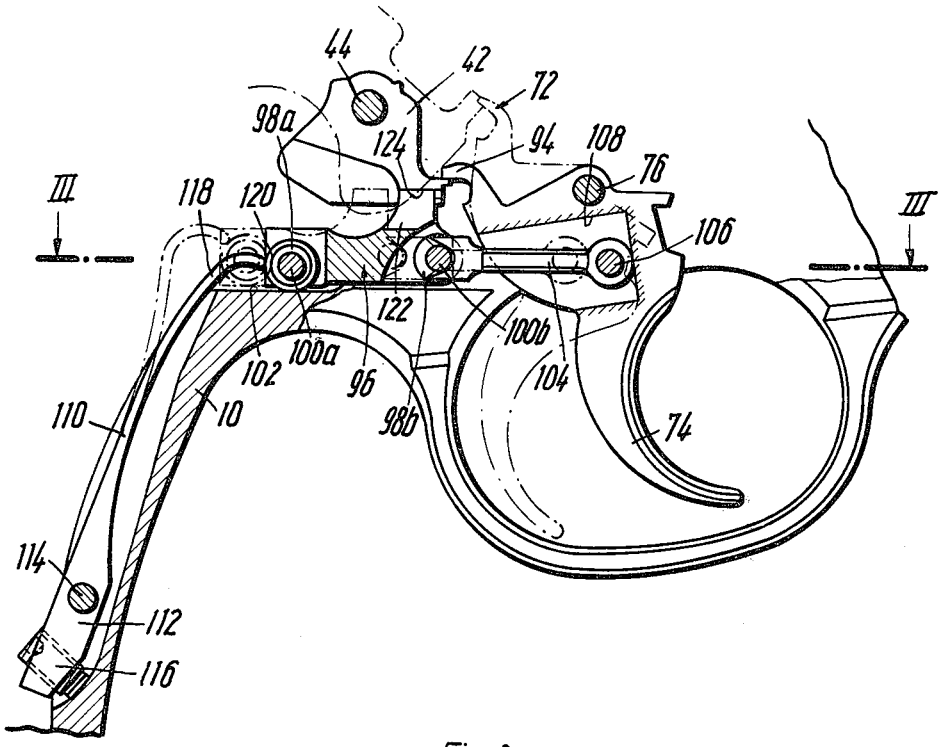
FIG. 2 is a fragmentary view in section of a portion of FIG. 1, but on a larger scale, the figure showing a detail of the trigger mechanism of the revolver of FIG. 1.
Figure 3:
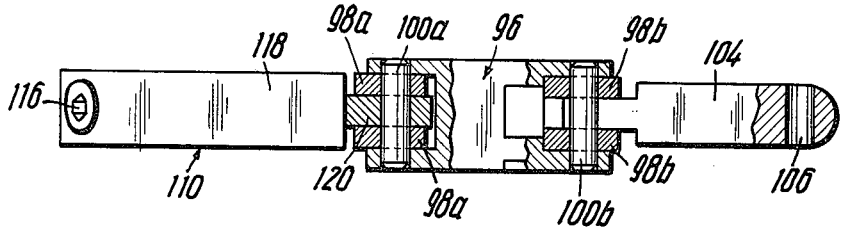
FIG. 3 is a fragmentary view in section, the section being taken along the line III—III of FIG. 2.
Figure 4:
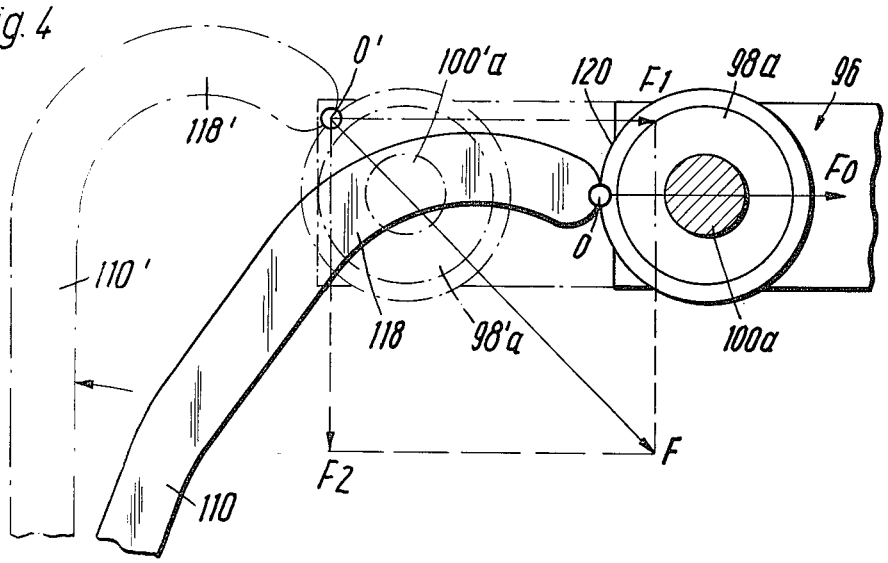
FIG. 4 is a fragmentary view on a large scale of a detail of FIG. 2, such view showing the displacement of the point of engagement of the trigger spring upon the rebounding slider.

In the drawings, the reference character 10 designates the frame of a hand-held revolver of the double-action type. The frame 10 is provided with a hollow grip portion 12, providing an interior space 14 which is closed by grip covers (not shown) which are removably affixed to the frame 10 by the intermediary of an assembling pin 16, in such way as to permit access to the space 14. The grip covers are situated so as to provide a perfect grip by the hand upon the revolver, particularly when the revolver is of large caliber.

A one-piece barrel 18, cold forged and having a desired length and interior bore size, carries a front sight 20 which is affixed to the frame 10 and is immobilized thereon by a locking cross pin 22.

A cylinder 24 having six tubular chambers 26 of the desired form and shape is rotatably mounted on an axle 28 in a conventional opening in the frame in such manner that the axis of each of the tubular chambers 26 in the cylinder 24 may be successively aligned with the axis of the barrel 18. The cylinder 24 is provided in a normal manner with an ejector 30 which is mounted coaxially thereon.

An adjustable rear sight 32 is disposed on the upper rear part of the frame 10. The adjustment of the sight 32 is effected by means of a screw threaded nut and post combination 34.

Means for removing the cylinder 24 from the frame 10 of the revolver, not shown in the drawings, is disposed upon the side of the revolver and acts upon a collar 36 which receives a tenon 38 upon the cylinder bearing shaft 28, such cylinder removing means overcoming the force exerted by a coil compressing spring 40 which urges the tenon 38 into the collar 36.

The space 14 in the frame 10 contains a hammer 42 which is pivotally mounted upon the frame by a fixed pivot pin 44, the hammer carrying a conventional firing or percussion pin 46 which may be integral therewith; as shown, the pin 46 is affixed to the hammer by a cross pin 48. A crank arm pivotally mounted on one of its ends upon a pivot pin 52 on the lower arm of the hammer 42 is connected at its other end by a stub shaft 54 to the other extremity of a first or hammer leaf sping 56. Such leaf spring 56, which has a non-uniform section, is anchored at its lower fixed extremity 58 in a spring-seat 60 which is formed on the interior of the space 14 of the handle 12 of the revolver. A screw 62 which is screw-threaded into a passage 64 in the frame permits the adjustment of the pretension of the spring 56. With such an arrangement, the hammer 42 is urged into rotation by the spring 56 in a clockwise direction, as it is shown in FIG. 1, around its pivot pin 44 toward the firing or percussion position shown in FIG. 7.

A careful forming of the spring 56 and its connection by the intermediary of the crank arm 50 to the hammer 42 assures a smooth and regular (although adjustable) force urging the hammer to rotate in a clock-wise direction around its pivot pin 44. In order to permit the double-action functioning of the revolver, the hammer 42 is also provided with a lever 66 which is mounted pivotally about a pin 68 upon the hammer 42 and which is urged in a counter-clockwise direction (FIG. 1) by a coil compression spring 70 which is disposed to act between the hammer 42 and the lever 66.

The control of the hammer is assured by a trigger mechanism generally designated by a reference character 72. This mechanism includes the following essential elements:

1. A trigger 74 pivotally mounted on the frame 10 about pivot pin 76 and adapted to actuate the elements of the mechanism 72 described below.

2. A conventional cylinder locking mechanism 78 adapted to maintain the cylinder 24 in a predetermined desired angular position corresponding to the allignment of the axis of one of the chambers in the cylinder with the axis of the barrel 18 in the final phase of the movement of the trigger 74 under the action of the marksman.

3. A mechanism for turning the cylinder 24 composed essentially of a lever 80 pivotally mounted upon a pin 82 on the trigger 74 in order to be yieldingly urged by a torsion spring 84 a part of which is wound around the pivot pin 82, spring 84 having one end thereof possibly engaging the pin 76, the other free end of the spring 84 cooperating the lever 80, lever 80 being provided with an incline or wedge 85 (see FIGS. 5 to 8 inclusive) which cooperates with a ratchet wheel 86 fixedly attached to the ejector 30 of the cylinder 24, in such manner as to permit the trigger 74 to turn the cylinder 24 about its axle 28 in the so-called initial phase of the displacement of the trigger.

Figure 5:
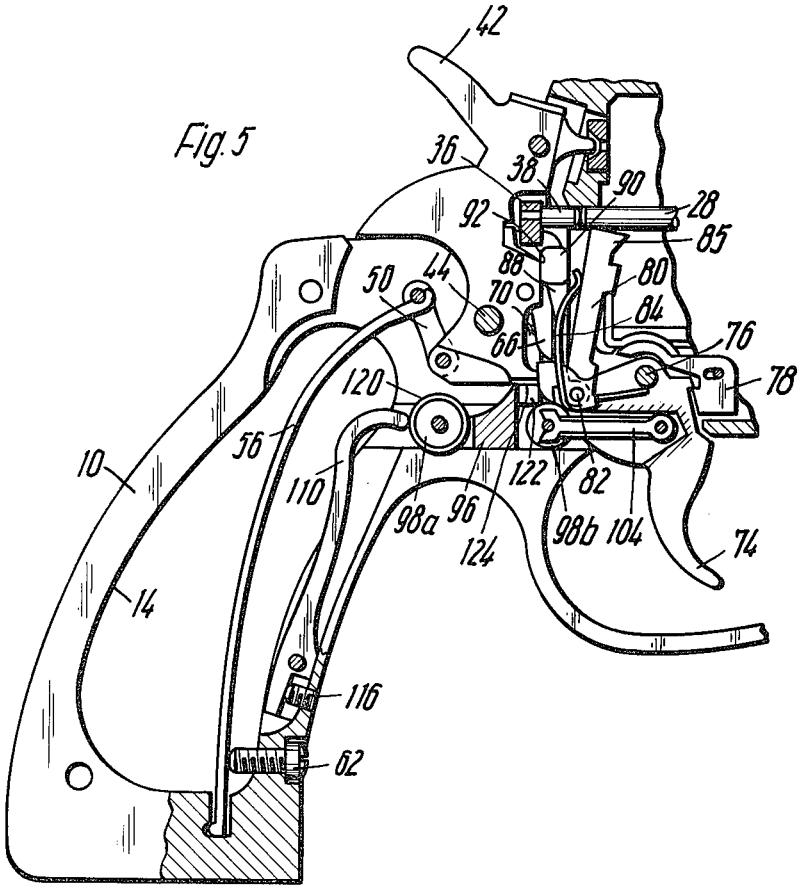
FIGS. 5, 6 and 7 are fragmentary schematic representations in section illustrating the relative positions of the different elements of the trigger mechanism of the revolver of FIG. 1, such figures showing, respectively, the advanced position, the cocked position, and the percussion position of the hammer.
Figure 6:
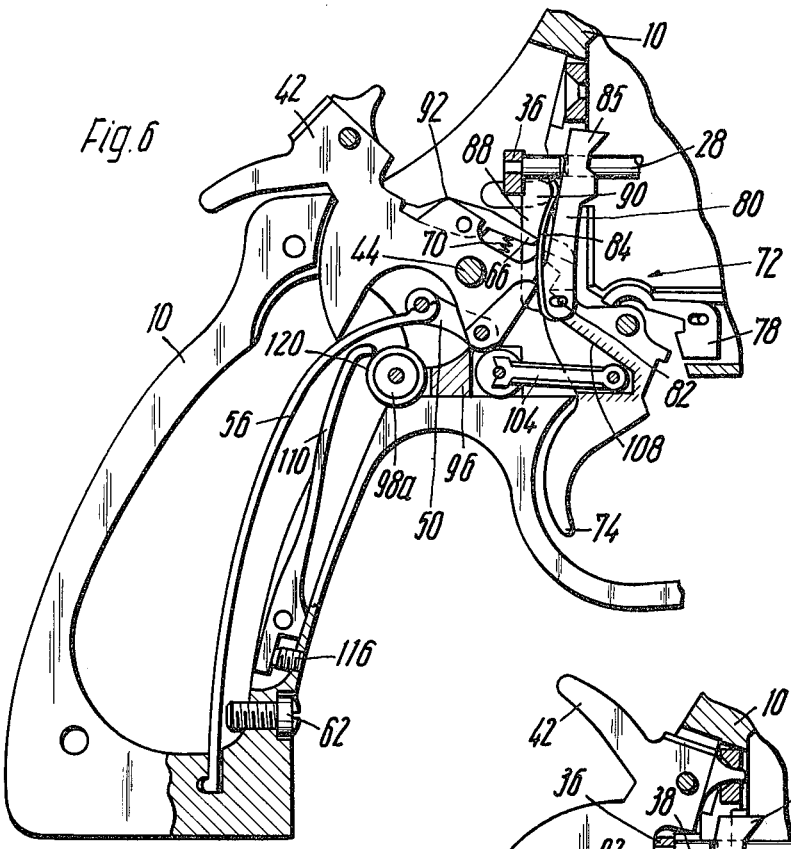
Figure 7:
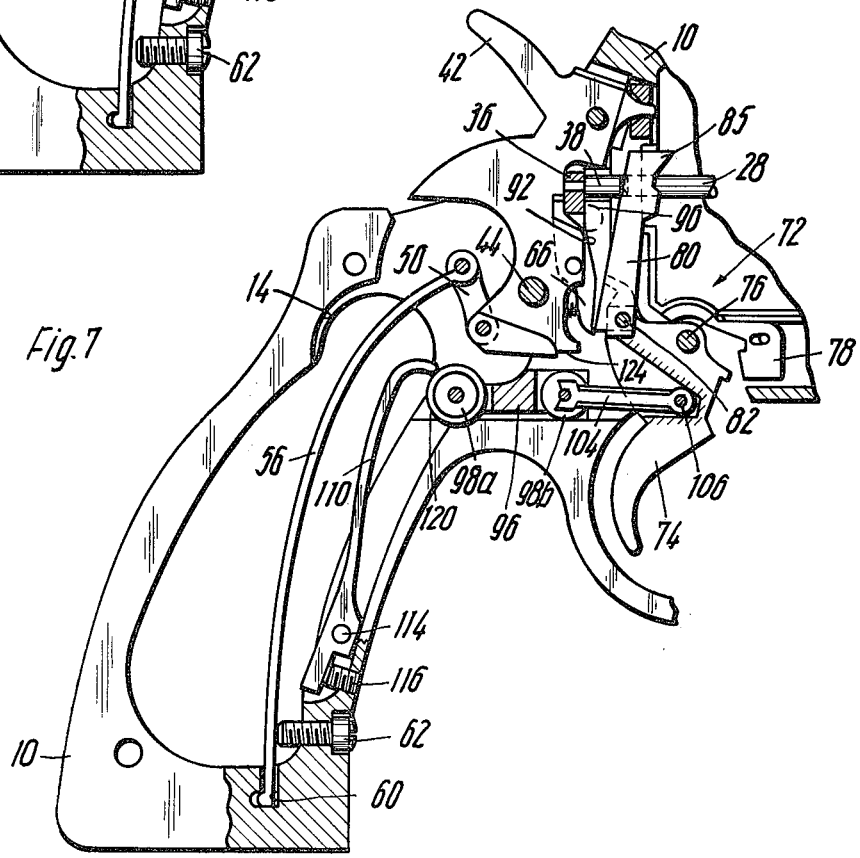

4. A supplemental safety composed (see in particular FIG. 8) of a movable element 88, one end of which is pivotally mounted upon the trigger 74 through the intermediary of the pivot pin 82 and the other end 90 of which forms an abutment capable of being interposed between the part of the frame 10 on which the axle shaft 24 is mounted and a surface of an abutment 92 (See FIGS. 5 to 7 inclusive) provided for this purpose upon hammer 42 when the trigger 74 occupies the repose position, as shown in FIG. 1. It is necessary to observe that this extremity 90 not only prevents the displacement of the hammer 42 toward the front, that is toward its firing or percussion position, in the advance position of the trigger 74, but also prevents, as shown in FIGS. 5, 6 and 7, the displacement toward the front of a means (not shown) operating the locking tenon 38 of the cylinder 24 when the trigger is operated by the marksman, thus preventing any false operation of the latter. In addition, the extremity 90 in the form of an abutment prevents the cocking of the hammer 42 by the trigger 74 when the operating means and the tenon 38 thereof have been pressed toward the front at the end of the indexing operation of the cylinder 24.

5. A double-acting mechanism operating the hammer 42, such mechanism which results from the cooperation of the above-described lever 66, with a finger 94 which is integral with the trigger 74, and is made in such manner as to permit, in the first phase of displacement of the trigger by the pull thereon by the marksman, to urge the hammer 42 towards its cocked position shown in FIG. 6 against the force of its recoiling or returning spring 56, and to cause thereafter in a final phase of its displacement the liberation of the hammer in such manner as to cause the functioning of the revolver in the known double-action manner.

6. A rebounding slider 96 disposed in such manner as to be able to be displaced by the trigger 74 in a straight-line movement of translation in the frame 10 parallel to the axis of the barrel 18.

Such displacement of the slider is facilitated (see in particular FIG. 3) by the disposition upon the latter of four round rollers **98*a* and 98*b* journalled for rotation upon the slider around two parallel axes 100*a* and 100*b* to roll upon two plane supporting surfaces 102 provided in the space 14 of the frame 10. The use of the rollers 98 permits the limiting to a minimum of the frictional forces which oppose the straight-line movement of the slider 96 with respect to the frame 10. The connection between the trigger 78 and the slider 96 is provided by means of a link or lever 104 which is pivotally mounted at one of its extremities on the one hand upon the pin 100***b* affixed to the slider 96, and on the other hand, upon a stub shaft 106 which is affixed to the trigger 74 and is disposed in a recess 108 in the trigger. The recoiling or return of the trigger 74 toward its rest position shown in FIG. 1 is assured by a second (trigger) spring 110 which acts upon the trigger 74 through the intermediary of the slider 96. Such spring 110 which is very carefully formed is constituted by a leaf spring in a form of a first-class lever (FIG. 2) which is very carefully formed and is pivotally mounted upon the frame 10 by a pivot pin 114 extending through an enlarged lower portion 112 of the spring. A threaded-pin 116 permits the position of the extremity 112 of the spring 110 to be defined with respect to the frame 10 and to thus adjust the pre-tensioning or recoiling force of the spring 110. The other end of the spring 110 is relatively thin, and curved such end acting upon the slider 96 through the intermediary of a curved abutment surface 120 advantageously formed for example, as represented, by a round roller pivotally mounted upon the slider 96 and the axle 100*a*. In a classical manner, the slider 96 is adapted to urge and maintain the hammer 42 in an intermediate safety position which is shown in FIGS. 1 to 5, inclusive, when the trigger 74 returns to its repose position, shown in FIG. 1 under the action of the spring 110. For this purpose, the slide 96 carries an upper projection 122 which cooperates with a corresponding engaging surface 124 which is made on the interior part of a nose of the hammer 42. The cooperation of the projection 122 and the surface 124 is such that after percussion, during the return of the trigger 74 towards its advance position and the displacement towards the front of the slider 96 under the action of the spring 110, the projection 122 in cooperation with the engaging surface 124 causes the hammer 42 to pivot against the resistance of its recoiling spring 56 so as to glide or slide under the engaging surface 124 and because of this to maintain hammer 42 in its intermediate, safety position.

The general manner of operation of the revolver described above, is classic and requires no further detailed description. This functioning will appear more clearly upon examination of FIGS. 5 to 7, inclusive, which illustrate the relative positions of the different elements of the trigger mechanism when the hammer 42 successively occupies the position of safety, cocked (positioned manually) and percussion. In the operation of the revolver in double-action, the trigger 74, by the cooperation of its finger 94 with the extremity of the lever 66 displaces the hammer 42 towards its cocked position, the action of the marksman upon the trigger overcoming the combined oppositions of the springs 56. and 110.

It is necessary to emphasize the action of the recoiling spring 110 on the slider 96, the novelty of this action residing in the relative displacement of the point of engagement ) of the spring 110 upon the abutment surface 120 of the slider 96 during the displacement toward rear of the latter, under the pivoting action of the trigger 74. More precisely, if one considers particularly FIG. 4, which represents the relative positions of the movable extremity 118 of the spring 110 and the abutment surface 120 of the slide 96, respectively, in the positions of repose and of the pulling of the trigger, it will be seen that the particular form in cross-section of the spring 110 and its position relative to the slider 96 permit the point of engagement O of the spring 110 upon the curved surface 120 to be displaced upwardly of such surface during the displacement to the rear of the slider 96. A similar displacement accompanies a corresponding changing of the orientation of the normal to the surface 120 at the point of engagement O of the spring 110. At that time, only the component $F_1$ of the force F exerted by the spring, such component being parallel to the displacement of the slider 96, must be taken into consideration, the vertical component $F_2$ was being in effect opposed by the rollers 98. In judiciously choosing elastic characteristics and the form of the spring 110, as well as the form of the above abutment surface 120, it is possible to achieve a cooperation between these elements such that the component $F_1$ of the force F of the spring 110 which has to be considered, maintain a practical and constant value no matter what the position of the slider 96 relative to the frame 10 may be, a value which is well known, equal to the initial force $F_0$ exerted by the spring 110 upon the slider 96 when the trigger 74 occupies its advance at rest position.

It follows thus, that the progressive displacement of the point of engagement O of the spring 110 upon the surface 120 permits the regularizing and even the rendering constant the action of the spring 110 upon the trigger 74; the possibility of adjustment by the screw 116 of the tension of the spring 110 permitting, by its action, the reduction of the "weight" exerted by the spring 110 upon the trigger to a minimum constant value compatible with the good functioning of the revolver. The force exerted by the spring 110 is sufficient not only to return the trigger 74 and the assembly of the elements of the mechanism 72 attached to the trigger to their repose positions, but also to return the hammer 42 against the force exerted by the spring 56 to its intermediate, safety position after percussion.

The adjustment of the tension of the spring 110 by the screw 116 it is thus related to the adjustment of the tension effectuated by the pin 62 upon the spring 56 for returning the hammer 42. In practice, force exerted by the marksman upon the trigger 74 upon the double-action operation of the revolver to cause the hammer 42 to reach its cocked position (shown in FIG. 5) is approximately equal to the force exerted by the marksman upon the trigger in order to overcome the returning force of the spring 110.

It is also necessary to point out that the rollers 98 with which the slider 96 is equipped permit the considerable reduction in the different frictional engagements of the apparatus between the slider 96 and the surface of the abutment 120 of the frame, particularly when the slider 96 travels under the engaging surface 124 on the hammer 42. The reduction of the frictional engagement permits the returning force of the spring 110 to be reduced, and the reduction of the force exerted by the spring 110 upon the trigger 74.

It is well known that the invention is not limited to the embodiment described and shown, and that numerous modifications are possible, particularly as concerns the form of the spring 110, the utilization of the surface 120, the mounting of the rollers 98, and the action of the slider 96, without departing from the teaching of the above described invention.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. In a double-action revolver comprising a frame, a hammer pivotally mounted on the frame for movement between a cocked position and a firing position, the hammer further exhibiting a safety position intermediate the cocked and firing positions, a first spring supported on the frame for urging the hammer toward its firing position, a trigger pivotally mounted on the frame, the trigger being adapted at an initial phase of its displacement from a rest position to cause the hammer to be urged toward its cocked position and thereafter, in the final phase of displacement of the trigger, to cause the release of the hammer and thus the pivoting of the hammer toward its firing position, rebounding slider means coupled to the trigger and slidably mounted in the frame, a second spring having a first end affixed to the frame and a second end engageable with the slider means for opposing the displacement of the trigger and for effecting the return of the trigger to its rest position, the slider means including a first portion for positioning the hammer in the safety position when the trigger is returned to the rest position, the improvement wherein the second trigger spring is in the form of an elongated elastic arm, and in which the slider means further comprises a second portion having a contact surface resiliently engageable by the second end of the elastic arm, and means coupling the first and second portions of the slider means for varying the position of engagement between the second end of the elastic arm and the contact surface of the second portion as a function of the relative position of the slider means on the frame to maintain the restoring force component parallel to the direction of movement of the slider means on the frame relatively constant irrespective of the position of the slider means on the frame.

2. A revolver according to claim 1, further comprising means for adjusting the position of the first end of the elastic arm relative to the frame to regulate the restoring force exerted by the elastic arm upon the trigger through the slider means.

3. A revolver according to claim 1, further comprising a supplemental interior safety operated by the trigger to prevent the hammer from reaching its firing position when the trigger is in its rest position.

4. In a double-action revolver, a frame, a hammer pivotally mounted on the frame for movement between a cocked position and a firing position, the hammer further exhibiting a safety position intermediate the cocked and firing positions, a first spring supported on the frame for urging the hammer toward the firing position, a trigger pivotally mounted on the frame, the trigger being adapted at an initial phase of its displacement from a rest position to cause the hammer to be urged toward its cocked position and thereafter, in the final phase of displacement of the trigger, to cause the released of the hammer and thus the pivoting of the latter toward its firing position, rebounding slider means coupled to the trigger and slidably mounted on the frame, and a second spring having a first end affixed to the frame and a second end engageable with the slider means for opposing the displacement of the trigger and for effecting a return of the trigger to the rest position, the slider means having a first portion for positioning the hammer in the safety position when the trigger is returned to the rest position, the improvement wherein the second spring comprises an elongated elastic arm, and in which the slider means further comprises a roller rotatably coupled to the first portion, the surface of the roller being resiliently engaged by the second end of the elastic arm, whereby the position of engagement between the second end of the elastic arm and the surface of the roller varies as a function of the relative position of the slider means on the frame to maintain the restoring force component of the elastic arm parallel to the direction of movement of the slider means relatively constant irrespective of the position of the slider means on the frame.

5. In a double-action revolver, a frame, a hammer pivotally mounted on the frame for movement between a cocked position and a firing position, the hammer further exhibiting a safety position intermediate the cocked and firing positions, a first spring supported on the frame for urging the hammer toward the firing position, a trigger pivotally mounted on the frame, the trigger being adapted at an initial phase of its displacement from a rest position to cause the hammer to be urged toward its cocked position and thereafter, in the final phase of displacement of the trigger, to cause the release of the hammer and thus the pivoting of the hammer toward its firing position, rebounding slider means coupled to the trigger and slidably mounted on the frame, and a second spring having a first end affixed to the frame and a second end engageable with the slider means for opposing the displacement of the trigger and for effecting the return of the trigger to the rest position, the slider means including a first portion for positioning the hammer in the safety position when the trigger is returned to its rest position, the improvement wherein the second spring is in the form of an elongated elastic arm, and in which the slider means further comprises, in combination, a pair of rollers, and a pair of axles spaced apart on the first portion for rotatably mounting the respective rollers on the first portion, the surface of one of the rollers being resiliently engageable by the second end of the elastic arm, whereby the position of engagement between the second end of the elastic arm and the surface of said last-mentioned roller varies as a function of the relative position of the slider means on the frame to maintain the restoring component of the elastic arm in a direction parallel to the movement of the slider means relatively constant regardless of changes in the position of the slider means on the frame.

* * * * *